US007448106B2

(12) United States Patent
Aiyar

(10) Patent No.: US 7,448,106 B2
(45) **Date of Patent: *Nov. 11, 2008**

(54) MOTORIZED DUAL-MODE CONTOUR-FOLLOWING MOP

(76) Inventor: Sanjay Aiyar, 2 Flagstone #656, Irvine, CA (US) 92606

( * ) Notice: Subject to any disclaimer, the term of this patent is extended or adjusted under 35 U.S.C. 154(b) by 0 days.

This patent is subject to a terminal disclaimer.

(21) Appl. No.: 11/946,398

(22) Filed: Nov. 28, 2007

(65) Prior Publication Data

US 2008/0066242 A1 Mar. 20, 2008

Related U.S. Application Data

(62) Division of application No. 11/465,961, filed on Aug. 21, 2006, now Pat. No. 7,328,477.

(51) Int. Cl.
*A47L 13/14* (2006.01)

(52) U.S. Cl. ..... 15/4; 15/97.1; 15/98; 15/230; 15/230.18; 15/230.19

(58) Field of Classification Search ..... 15/4, 15/52, 97.1, 98, 230, 230.17, 230.18, 230.19
See application file for complete search history.

(56) References Cited

U.S. PATENT DOCUMENTS 908,791 A 1/1909 Mason
1,069,960 A 8/1913 Kubick
1,393,532 A 10/1921 Howard, Sr.
1,617,838 A * 2/1927 Fennell ..... 15/230.18
1,665,292 A * 4/1928 Anderson et al. ..... 15/230.18
1,796,787 A * 3/1931 Hatfield ..... 15/97.1
2,682,071 A 6/1954 Linderoth
2,887,712 A 5/1959 Vosbikian et al.
4,032,239 A 6/1977 Maupin
5,522,110 A 6/1996 Borofsky
6,253,408 B1 7/2001 Feld et al.
6,675,427 B1 1/2004 Chiapelli et al.
2006/0070196 A1 4/2006 Lacotta et al.

* cited by examiner

*Primary Examiner*—Mark Spisich
(74) *Attorney, Agent, or Firm*—Quick Patents, Inc.; Kevin Prince

(57) ABSTRACT

A motorized scrubbing implement for cleaning a surface with contours is disclosed. The scrubbing implement includes a resilient base that includes a plurality of resilient fingers, each of which extend radially away from center of the base. A rigid cap comprises an inside upper end and a wider open lower end. The cap preferably includes a handle receiving means pivotally fixed to the cap for receiving a threaded end of an elongated handle. A flexible pad is included that comprises a cleaning surface on a lower side thereof. The pad has a peripheral lip forming an aperture in the pad for receiving the distal ends of each finger of the base. A rotational scrubbing surface driven by a motor projects through a central aperture in the pad.

9 Claims, 5 Drawing Sheets

Fig. 4
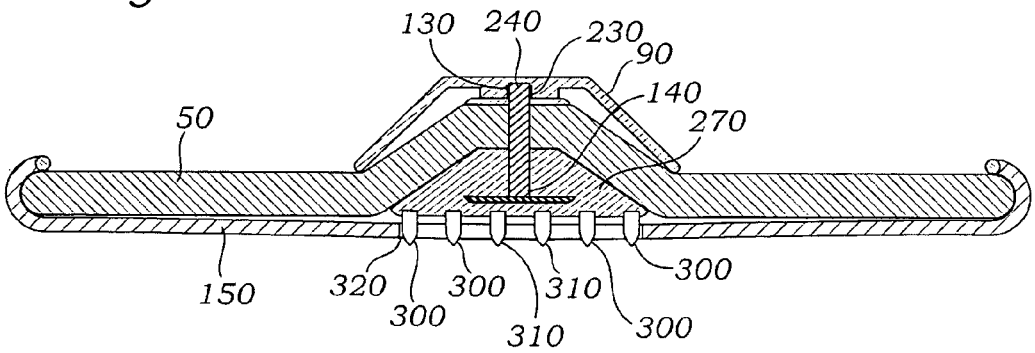
Fig. 5A
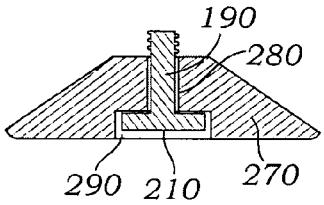
Fig. 5B
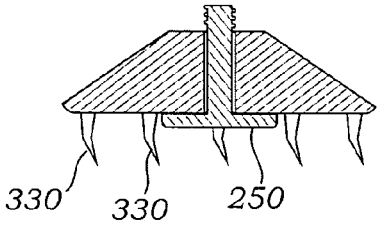
Fig. 5C
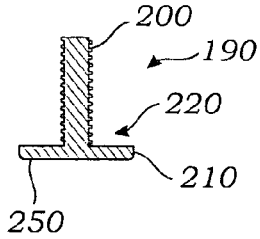
Fig. 5D
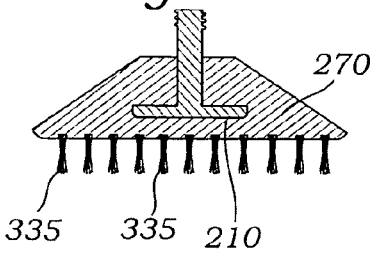
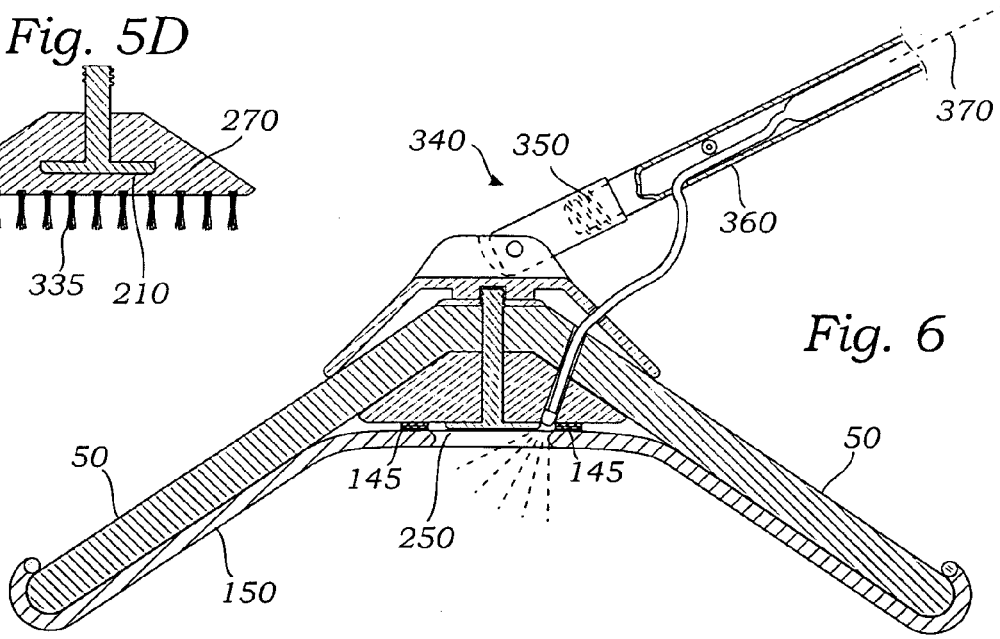
Fig. 6

MOTORIZED DUAL-MODE CONTOUR-FOLLOWING MOP

CROSS-REFERENCE TO RELATED APPLICATIONS

This application is a divisional application of Ser. No. 11/465,961, filed Aug. 21, 2006, now U.S. Pat. No. 7,328,477, issued on Feb. 12, 2008.

STATEMENT REGARDING FEDERALLY SPONSORED RESEARCH AND DEVELOPMENT

Not Applicable.

FIELD OF THE INVENTION

This invention relates to mops, and more particularly to a motorized dual-mode contour-following mop.

DISCUSSION OF RELATED ART

Mops for cleaning cars are well known in the art. For example, the highly successful Shawala® multi-layer mop of U.S. Pat. No. 5,855,204, to Gray et al. on Jan. 5, 1999, teaches such a device. Such mops are made to conform to contours typical of motor vehicles, as a flat mop is essentially useless on such surfaces. The Gray device relies on the weight of water in a plurality of fingers to cause the fingers to follow contours on the surface.

However, such weight is not always sufficient to create a strong enough cleaning force around such contours. Further, the central area of this device is too rigid and flat to adapt itself to contours.

Mop devices that create a stronger cleaning force between cleaning elements and the surface to be cleaned are also known in the art. For example, U.S. Pat. No. 2,727,268 to Hucke on Dec. 20, 1955, discloses a mop having a resilient, deformable washing head. U.S. Pat. No. 2,682,071 teaches a cleaning implement having a deformable suction foot that forces the cleaning implement into firm contact with a surface to be cleaned through an air suction means. While such devices do create a stronger cleaning force for cleaning a contoured surface, such devices are not well suited for concentrated scrubbing of areas of the surface that have caked-on or greasy areas in need of cleaning. For example, bird droppings, oil, or other stubborn grime is difficult to remove with such prior art devices.

U.S. Pat. No. 4,032,239 to Maupin on Jun. 28, 1977, also teaches a device having resilient contour-following fingers. The Maupin device is difficult to use due to its loose cleaning pad at the center which tends to interfere with cleaning the surface and, during application of any downward pressure, tends to play one side against the other, thus limiting its effectiveness on contoured surfaces. The loose cleaning surface, rather than applying a downward scrubbing force, relies strictly on the force of gravity to clean the surface. This is a drawback from which many prior art devices suffer.

The Maupin device, however, additionally includes a means for introducing a jet of water or cleaning fluid to the surface. While such a water jet may help remove stubborn debris to some extent, such a device does not provide for a concentrated water jet sufficient for removing all such debris. Further, a flexible mop pad necessarily is interposed between the water jet and the debris, further reducing the effectiveness of such a device.

Further, no prior art mops provides a motorized secondary cleaning surface that selectively engages the surface to be cleaned upon compression of the flexible fingers of the mop. Such a features would provide for additional scrubbing ability when needed.

Therefore, there is a need for a contour-following mop that, in addition to providing resilient fingers that can be forced against the surface to generate true scrubbing action rather than a weak "mopping-only" type of force, further provides a secondary mode wherein direct pressure of a selectively motorized secondary cleaning surface may be applied to stubborn debris. Such a necessary secondary cleaning surface would be rubber nibs, brush bristles, or even scraping edges. Such a needed device would further provide means for rotating the secondary cleaning surface to provide a motorized spot cleaning capability. The needed device would further be relatively inexpensive to manufacture and assemble, easy to use and clean, and would be durable under repeated use. The present invention accomplishes these objectives.

SUMMARY OF THE INVENTION

The present device is a scrubbing implement for cleaning a surface. The scrubbing implement includes a resilient base that is comprised of a plurality of resilient fingers, each of which extends radially away from center of the base. Each finger includes a distal end opposite a proximal end. A rigid cap comprises an inside upper end and a wider open lower end. The cap preferably includes a handle receiving means pivotally fixed to the cap for receiving one end of an elongated handle.

A flexible pad is included that comprises a cleaning surface on a lower side thereof The pad has a peripheral lip forming an aperture in the pad for receiving the distal ends of each finger of the base. Additionally, the center of the pad is attached to the center of the base to provide a close attachment to the entire lower base plane. In use, the base is fixed to the cap with an attachment means that forces the fingers of the base to extend downward in a radial fashion. The flexible pad is fixed at the center of the resilient base and around the distal ends of the fingers such that the pad may be applied to the surface to scrub the surface. The fingers and flexible pad conform to the shape of the surface.

Preferably a secondary resilient base is affixed under the resilient base. The secondary resilient base is of sufficient thickness to make contact with a surface to be cleaned when the primary resilient base is in a fully compressed position. The flexible pad preferably has an opening in the center of roughly the size of the secondary resilient base. In this case the flexible pad is attached to the resilient base in a ring fashion at the center in addition to the attachment at the periphery. Preferably, a secondary pad having different scrubbing characteristics than the main flexible pad is mounted to the bottom of the secondary base. The secondary pad may include at least one scrubbing nib for contacting the surface to be cleaned. As such, with the fingers pressed firmly against the surface, each of the scrubbing nibs contacts the surface, thereby providing additional scrubbing force to the surface. Preferably each scrubbing nib is a resilient rubber material, a brush material, a scraping material with a scraping edge, or the like.

The scrubbing implement further includes a liquid-tight motor rigidly attached to the outside of the cap. The motor has a rotating motor shaft that projects into the interior of the cap and extends through the resilient base and the flexible pad, preferably through a hollow aperture in the attachment means. The motor is electrically connected to a power source, and a switch is electrically disposed therebetween for selectively activating the motor. Alternately, the motor may be activated by a switch that is depressed when upward pressure is exerted on the motor shaft.

The secondary resilient base is affixed to the motor shaft, preferably in a readily detachable fashion. A secondary flexible pad is fixed to the secondary resilient base and includes a cleaning surface on a lower side thereof. The secondary resilient base may instead be a brush or a scraper, for instance. In use, such an embodiment allows for motorized rotational scrubbing of the surface when the fingers are in the compressed orientation and the switch is actuated.

The present device is a contour-following mop that, in addition to providing padded resilient fingers that may be forced against the surface, further provides a secondary mode wherein direct pressure of a secondary cleaning surface may be applied to clean stubborn debris. The secondary cleaning surface may be a firm scrubbing pad, resilient rubber nibs, brush bristles, or even scraping edges. The present invention further provides means for rotating the secondary cleaning surface to provide a motorized spot cleaning capability. The present device is relatively inexpensive to manufacture, easy to use and clean, and is durable under repeated use. Other features and advantages of the present invention will become apparent from the following more detailed description, taken in conjunction with the accompanying drawings, which illustrate, by way of example, the principles of the invention.

DESCRIPTION OF THE DRAWINGS

FIG. 4 is a cross-sectional view of the invention, taken generally along lines 2-2 of FIG. 1, and illustrating the secondary resilient base with the plurality of scrubbing nibs, the nibs for making contact with the surface to be cleaned;

FIG. 5A is a cross-sectional view of one embodiment of the secondary resilient base, illustrating a recess in the secondary resilient base for complete encompassment of a head of a bolt;

FIG. 5B is a cross-sectional view of an alternate embodiment of the secondary resilient base, illustrating a plurality of scraping edges attached thereto and to the head of the bolt;

FIG. 5C is a cross-sectional view of the bolt;

FIG. 5D is a cross-sectional view of an alternate embodiment of the secondary resilient base, illustrating a plurality of brush bristles attached thereto and to the head of the bolt;

FIG. 6 is a cross-sectional view of an alternate embodiment of the invention, illustrating a nozzle for selectively spraying a cleaning fluid through the pad and onto the surface to be cleaned;

DETAILED DESCRIPTION OF THE PREFERRED EMBODIMENT

Figure 1:
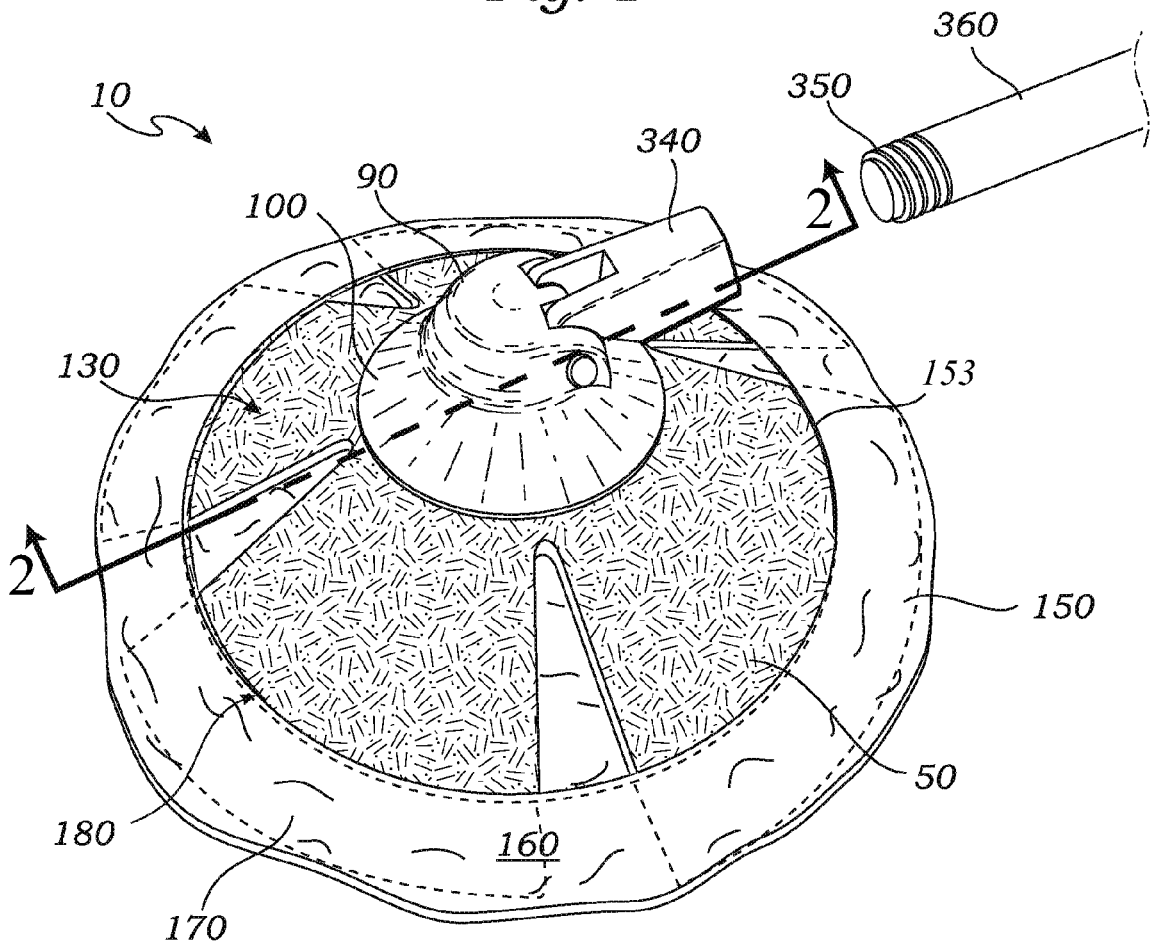
FIG. 1 is a perspective view of the invention, illustrating a scrubbing implement detached from an elongated handle of the invention.

FIGS. 1 and 3 illustrate a scrubbing implement 10 for cleaning a surface 20. The scrubbing implement 10 includes a resilient base 30 that includes a plurality of resilient fingers 50, each of which are joined at a proximal end 60 to a hub 40 and extend radially away therefrom. Each finger 50 includes a distal end 70 opposite the proximal end 60. Preferably the hub 40 further includes a central aperture 80 therethrough. The resilient base 30 is preferably made from a resilient foam material such as EVA, or the like.

Figure 3A:
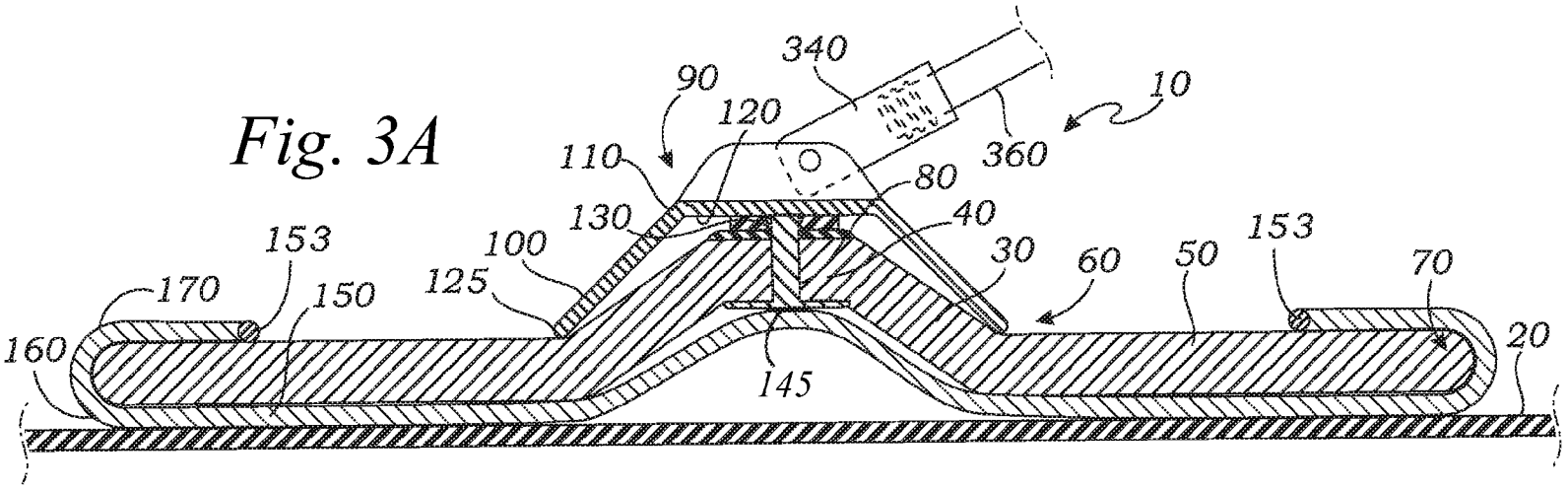
FIG. 3A is a cross-sectional view of the invention, taken generally along lines 2-2 of FIG. 1, and illustrating the resilient base with the radially-extending fingers in a compressed configuration, the scrubbing implement and the resilient base engaged with a surface to be cleaned.
Figure 3B:
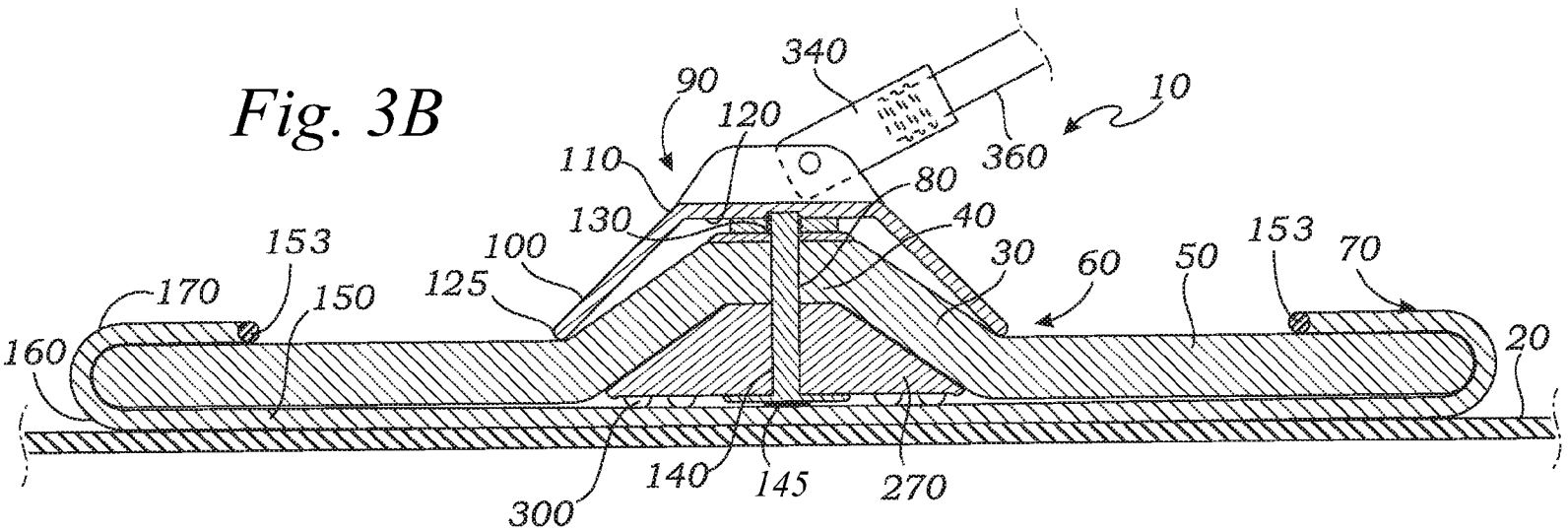
FIG. 3B is a cross-sectional view of the invention, taken generally along lines 2-2 of FIG. 1, and illustrating the secondary base and scrubbing nibs reinforcing the center of the flexible pad.

A rigid cap 90 comprises an inside upper end 120 and a wider open lower end 125. A frusta-conical side portion 100 is fixed at a top end 110 thereof to the upper end 120 of the cap 90. The upper end 120 preferably includes a central aperture 130 at least partially therethrough. The cap 90 preferably includes a handle receiving means 340 pivotally fixed to the cap 90 for receiving preferably a threaded end 350 of an elongated handle 360 (FIGS. 1 and 6), but may be adapted for receiving a snap-in end of an elongated handle (not shown), or any other type of commonly-used handle. The cap 90 is preferably made from a rigid plastic material, but can also be formed from wood or metal, if desired. A flexible pad 150 is included that comprises a cleaning surface 160 on a lower side thereof. The pad 150 has an elastic ring 153 around its periphery, forming an aperture 180 in the pad 150 for receiving the distal ends 70 of each finger 50 of the base 30. The pad 150 is mounted to the base 30 by inserting the distal ends of the fingers 50 into the peripheral lip 170 and held in place securely by the elastic ring 153. It is additionally attached to the base 30 with an attachment means 145, such as hook-and-loop type material (FIGS. 3A and 3B). The attachment means 145 ensures a close contact of the pad 150 with the base 30. In use, the base 30 is fixed to the cap 90 with the attachment means 140. The flexible pad 150 is fixed around the distal ends 70 of the fingers 50 such that the pad 150 may be applied to the surface 20 to scrub the surface 20. The fingers 50 and flexible pad 150 conform generally to the shape of the surface 20.

In an alternate embodiment of the invention, the flexible pad 150 may comprises separate pockets (not shown) each for accepting therein one of the fingers 50, such that each finger 50 is more free to move with respect to the other fingers 50.

Figure 2A:
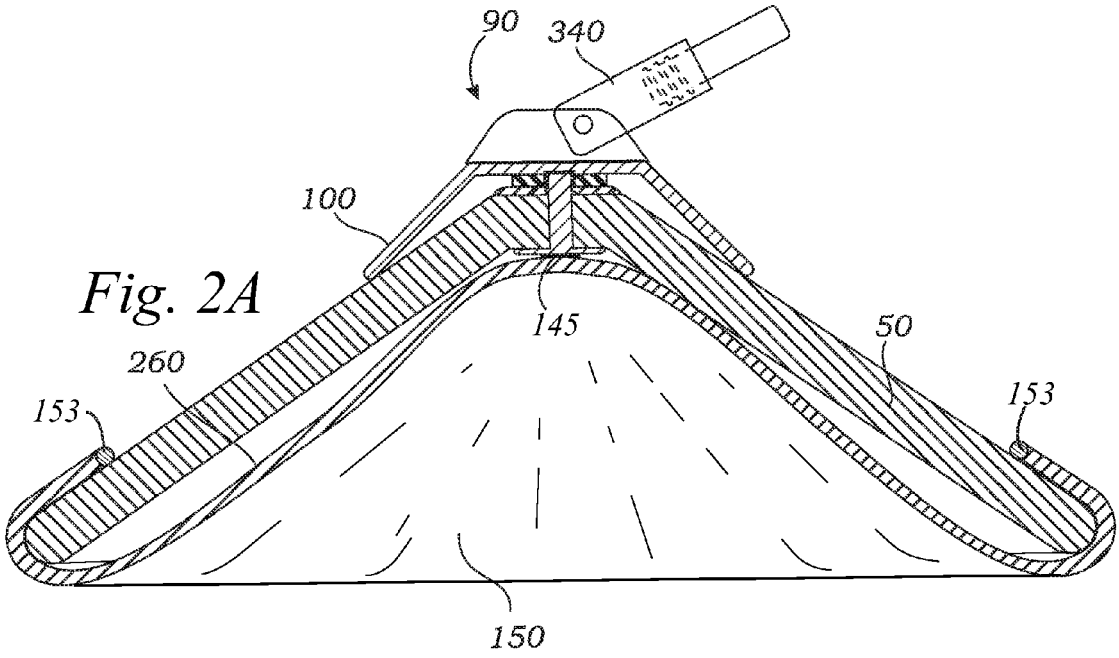
FIG. 2A is a cross-sectional view of the invention, taken generally along lines 2-2 of FIG. 1, and illustrating a resilient base with radially-extending fingers in an uncompressed configuration.

An attachment means 140 for fixing the base 30 to the cap 90 at the central apertures 80,130 thereof is further included. The side portion 100 of the cap 90 forces the fingers 50 of the base 30 into a downward direction, as well illustrated in FIGS. 2A and 2B. Preferably the attachment means 140 includes a bolt 190 having a threaded shaft 200 and a head 210 at one end 220 of the shaft 200 (FIG. 5C). The head 210 is larger in diameter than the aperture 80 of the base 30. The head 210 of the bolt 190 has a lower side 250 for attaching to the back side 260 of the flexible pad 150 proximate the center of the flexible pad 150 with the attachment means 145, such as a hook and loop type fastening material, a mechanical snap (not shown), or the like. Further, the cap 90 has a receiving thread 230 in a top portion 240 of the aperture 130 thereof. The receiving thread 230 rotatably receives the threaded shaft 200 of the bolt 190. Clearly, however, other attachment means 140 could be devised by those skilled in the art, such as adhesive, alternate mechanical means, or the like (not shown). Further, the cap 90 may be made integral with the resilient base 30 if made from a suitably resilient material that provides rigidity to the fingers 50 in the downward direction, yet is resilient enough such that the fingers 50 may still flex upward into a compressed orientation (as illustrated in FIG. 3A and FIG. 3B). Preferably a secondary resilient base 270 is included that has a central aperture 280 therein for receiving the bolt 190. The secondary resilient base 270 is positioned between the head 210 of the bolt 190 and the resilient base 30. As such, the lower side 250 of the head 210 of the bolt 190 may be positioned closer to the flexible pad 150 than the cap 90 (FIG. 3B). The secondary resilient base 270 may further include a recess 290 for the head 210 of the bolt 190, such that the secondary resilient base 270 and the flexible pad 150 attach flatly (FIG. 5A). Alternately, the head 210 of the bolt 190 may be embedded within the secondary resilient base 270 (FIGS. 2B, 4 and 5D).

In an alternate embodiment of the invention, the secondary resilient base 270 includes brush bristles 335 (FIG. 5D). In this alternative embodiment the flexible pad 150 has an opening 320 in the center thereof to allow the brush bristles 335 to make contact with the surface 20. As such, the attachment means 145 takes the shape of a ring (FIG. 6) surrounding the opening 320.

Figure 2B:
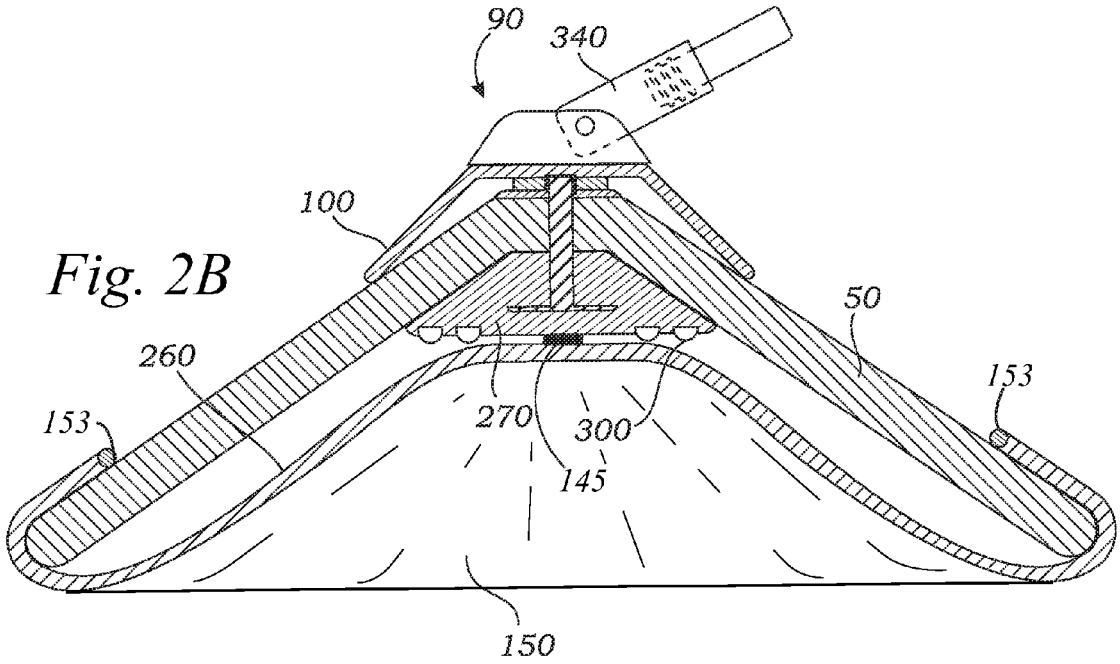
FIG. 2B is a cross-sectional view of the invention, taken generally along lines 2-2 of FIG. 1, and illustrating a secondary resilient base with scrubbing nibs on a lower surface thereof.

The secondary base 270 may include at least one scrubbing nib 300 for contacting the back side of the pad 150 (FIG. 2B). As such, with the fingers 50 pressed firmly against the surface 20 each of the scrubbing nibs 300 contacts the back side 260 of the pad 150 to reinforce the pad 150 against the surface 20. As such, additional scrubbing force may be applied to the surface 20 when desired simply by pressing the scrubbing implement 10 firmly into the surface 20 to cause the scrubbing nibs 300 to contact the surface 20. The lower side 250 of the head 210 of the bolt 190 may also include at least one scrubbing nib 310 for contacting the pad 150 (not shown).

The pad 150 may include the second smaller aperture 320 in the approximate center of the pad 150, such that each scrubbing nib 300, 310 of the secondary resilient pad 270 and the bolt 190 may traverse the second aperture 320 and contact the surface 20 directly when the fingers 50 of the base 30 are pressed firmly against the surface 20 so that the fingers assume the compressed orientation (FIG. 4). Preferably each scrubbing nib 300,310 is a resilient rubber material, a brush material, or a scraping material with a scraping edge 330 (FIGS. 5A and 5B). In the embodiment including a scraping edge 330, preferably a longitudinal axis 370 of the handle 350 (FIG. 6) is generally orthogonal to each scraping edge 330, such that each scraping edge 330 contacts the surface 20 along the edge 330 in a direction orthogonal thereto, so as not to damage the surface 20.

Figure 7:
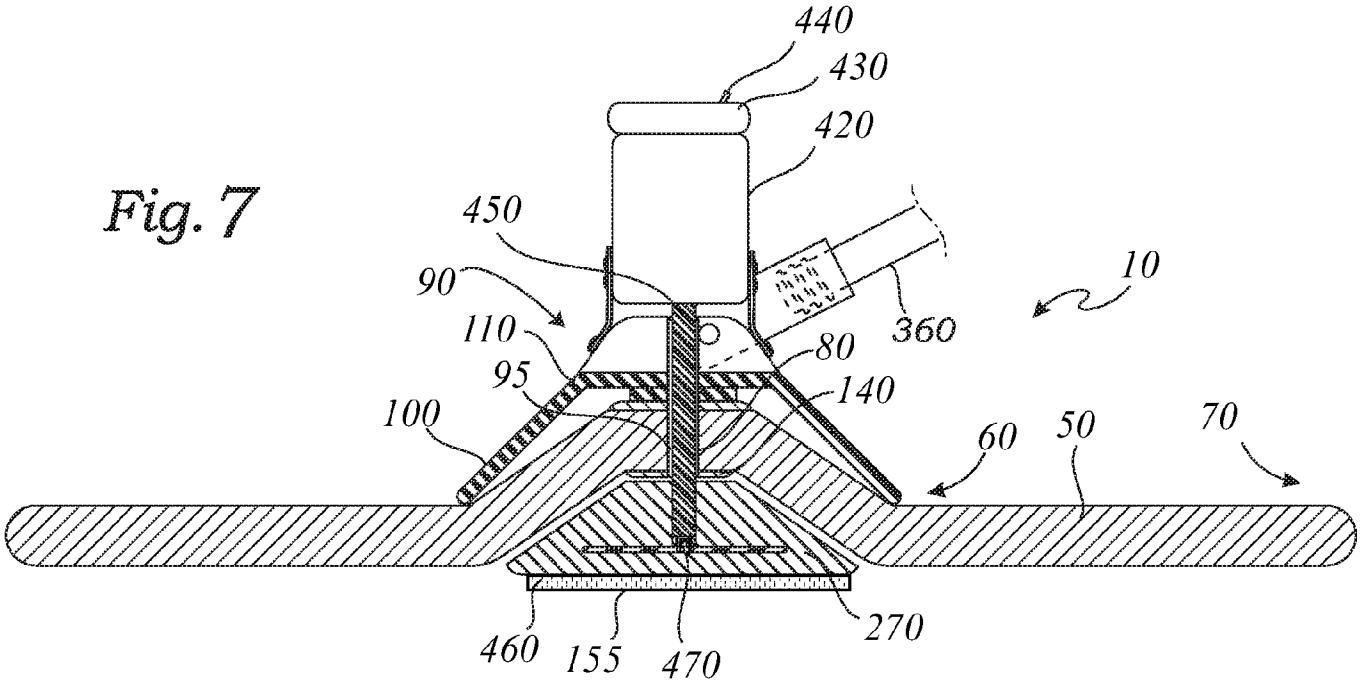
FIG. 7 is a cross-sectional view of the invention, illustrating a motor and a motor shaft connected to an additional rotating cleaning surface.

Preferably, as illustrated in FIG. 7, the scrubbing implement 10 further includes a liquid-tight motor 420 rigidly attached to the outside of the cap 90. The motor 420 has a rotating motor shaft 450 that projects through the center of and into the interior of the cap 90 and extends through the resilient base 30 and the flexible pad 150, preferably through a hollow aperture 95 in the attachment means 140 and preferably without making contact with the cap 90, the resilient base 30, or the flexible pad 150. The motor 420 is electrically connected to a power source 430, such as a battery or other line current source, and a switch 440 is electrically disposed therebetween for selectively activating the motor 420. Alternately, the motor 420 may be activated by a switch 440 that is depressed when upward pressure is exerted on the motor shaft 450 (not shown) through application thereof to the surface 20.

Figure 8:
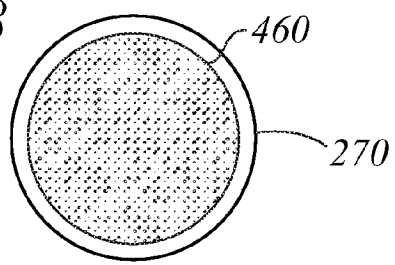
FIG. 8 is a bottom-plan view of the additional rotating cleaning surface of FIG. 7.

In such an embodiment, the secondary resilient base 270 is rotatably affixed to the motor shaft 450 (FIG. 8), preferably in a readily detachable fashion such as with a bolt 470 or push-actuated clamping means (not shown). A secondary flexible pad 460 is fixed to the secondary resilient base 270 and includes a cleaning surface 155 on a lower side thereof. The secondary resilient base 270 may include the brush bristles 335. In use, such an embodiment allows for motorized rotational scrubbing of the surface 20 when the fingers 50 are in the compressed orientation and the switch 440 is actuated. Any water or soap thrown from the rotating secondary base 270 is naturally caught or deflected downward by the flexible pad 150 or the fingers 50.

The motor 420 and the power source 430 may alternately be mounted (not shown) to the handle 360 . In such an embodiment, the rotating motor shaft 450 is further connected to a rotation-transmitting cable to the cap 90. As such, the scrubbing implement 10 could be fully submerged in a bucket of soapy water, for example, without also submerging the motor 420 (not shown).

While a particular form of the invention has been illustrated and described, it will be apparent that various modifications can be made without departing from the spirit and scope of the invention. For example, the round shape of the resilient base 30 and the pad 150 may be modified to be oval, square, rectangular, or any other suitable shape (not shown). Likewise, the exact number of fingers 50 may be modified from that illustrated in the drawings. Accordingly, it is not intended that the invention be limited, except as by the appended claims.

What is claimed is:

1. A scrubbing implement for cleaning a surface comprising:

a rigid cap, the cap comprising an inside upper end and a wider open lower end;

a resilient base attached to the inside upper end of the cap, the base comprising a plurality of fingers extending radially outwards and downward from within the cap, the downward angle of the fingers defined by the cap;

a flexible pad located under and mounted to the base, the lower side of the pad forming a cleaning surface;

a motor attached to the outside of the cap, the motor having a rotating motor shaft, the motor shaft projecting into the interior of the cap and extending through the base and the pad without making contact with the cap, the base, or the pad;

a smaller secondary resilient base located under the pad and affixed rotatably to the motor shaft;

a secondary cleaning member located under and mounted to the secondary base, the secondary cleaning member including a cleaning surface on a lower side thereof;

wherein the base and the pad generally conform to and extend down and out from the inside of the cap and provide a resilient scrubbing surface for application to the surface, the fingers and the pad conforming to the shape of the surface, the secondary base and the secondary cleaning member, forming a rotating cleaning surface that contacts the surface when the fingers of the base are in a compressed orientation.

2. The scrubbing implement of claim 1 wherein the secondary base is detachably affixed to the motor shaft.

3. The scrubbing implement of claim 2 wherein the secondary cleaning member comprises a brush.

4. The scrubbing implement of claim 2 wherein the secondary cleaning member comprises a scraper.

5. The scrubbing implement of claim 1 further including a handle receiving means pivotally fixed to the cap.

6. The scrubbing implement of claim 1 further including a handle fixed to the cap, the handle providing a means for hand application of the scrubbing implement to the surface.

7. The scrubbing implement of claim 1 wherein the rigid cap and the resilient base are integrally formed.

8. The scrubbing implement of claim 1 wherein the secondary cleaning member comprises a flexible pad.

9. A scrubbing implement for cleaning a surface comprising:

a rigid cap, the cap comprising an inside upper end and an open lower end;

a handle fixed to the cap, the handle providing a means for hand application of the scrubbing implement to the surface, a resilient base attached with the inside upper end of the cap, the base comprising a plurality of fingers extending radially outwards and downward from within the cap, the downward angle of the fingers defined by the cap;

a flexible pad located under and mounted to the base, the lower side of the pad forming a cleaning surface;

a motor coupled to a rotary drive member projecting into the interior of the cap and extending through the base and the pad;

a smaller secondary resilient base located under the pad and rotatably coupled to the rotary drive member;

a flexible secondary pad located under and mounted to the secondary base, the secondary pad including a cleaning surface on a lower side thereof;

wherein the base and the pad generally conform to and extend downward and outward from the inside of the cap and provide a resilient scrubbing surface for application to the surface, the fingers and the pad conforming to the shape of the surface, the secondary base and the secondary pad, forming a rotating cleaning surface that contacts the surface when the fingers of the base are in a compressed orientation.

* * * * *